United States Patent [19]

Duprez

[11] Patent Number: 4,672,920

[45] **Date of Patent: * Jun. 16, 1987**

[54] PRESSURE COMPENSATED TEMPERATURE SWITCH UNIT FOR PROTECTION OF AN INTERNAL COMBUSTION ENGINE

[76] Inventor: Wayne R. Duprez, c/o Standard-Thomson Corporation, 152 Grove St., Waltham, Mass. 02254-9109

[ * ] Notice: The portion of the term of this patent subsequent to May 13, 2003 has been disclaimed.

[21] Appl. No.: 819,721

[22] Filed: Jan. 17, 1986

Related U.S. Application Data

[63] Continuation-in-part of Ser. No. 680,279, Dec. 10, 1984, Pat. No. 4,587,931.

[51] Int. Cl.[4] ..... F01P 11/16

[52] U.S. Cl. ..... 123/41.15; 340/57; 340/592

[58] Field of Search ..... 123/41.15; 374/145, 374/203; 116/101-103; 340/57, 592

[56] References Cited

U.S. PATENT DOCUMENTS

| | | | |
|---|---|---|---|
| 3,753,256 | 8/1973 | McDonald | 340/592 |
| 3,898,614 | 8/1975 | Watt | 340/592 |
| 4,262,274 | 4/1981 | Howe et al. | 374/203 |
| 4,299,117 | 11/1981 | Andrews et al. | 374/145 |

FOREIGN PATENT DOCUMENTS

| | | | |
|---|---|---|---|
| 488838 | 7/1938 | United Kingdom | 374/145 |

*Primary Examiner*—William A. Cuchlinski, Jr.

[57] ABSTRACT

A pressure compensated temperature switch for the protection of an internal combustion engine or the like. The switch unit includes a housing, a portion of which is positioned within a passage in the cooling system of the internal combustion engine. Within the housing is a pressure sensitive member. The pressure sensitive member senses both the temperature and the pressure of the coolant fluid in the coolant system of the internal combustion engine. A visual and/or audible alarm device, which is connected to a switch unit of this invention, thus operates when temperature conditions exist within an engine which are harmful to the engine.

13 Claims, 2 Drawing Figures

PRESSURE COMPENSATED TEMPERATURE SWITCH UNIT FOR PROTECTION OF AN INTERNAL COMBUSTION ENGINE

RELATED PATENT APPLICATION

This invention is a continuation-in-part application of patent application Ser. No. 680,279, filed Dec. 10, 1984, now U.S. Pat. No. 4,587,931.

BACKGROUND OF THE INVENTION

Most automotive internal combustion engines have a coolant system which includes fluid conduits within the engine and adjacent the engine, and a heat exchanger through which coolant liquid flows.

For the protection of the internal combustion engine against overheating, an alarm, audible, and/or visual, to the operator should be activated if the temperature of the engine becomes excessive.

One major consideration in the protection of an internal combustion engine is that the coolant fluid in the coolant system must remain substantially in liquid form and should not be permitted to boil. The boiling point of the coolant liquid depends upon the composition thereof and also depends upon the pressure applied to the coolant liquid within the coolant system.

A coolant system of an internal combustion engine usually is a closed system in which a pressure cap closes the passage through which the coolant liquid is introduced into the coolant system. The pressure cap is designed to maintain a predetermined operating pressure within the coolant system. If a predetermined operating pressure in the coolant system could always be precisely maintained, the problems involved with regard to protection of the engine against excessive temperatures would be significantly reduced. If a predetermined operating pressure were always maintained in the coolant system, monitoring of the temperature of the engine would be the principal requirement for protection of the engine.

However, as a practical matter, the pressure in the coolant system cannot be properly or effectively controlled. This is due to the fact that the pressure cap is customarily one which has a pressure tolerance range. Also, an aging pressure cap permits a change in the operating pressure maintained in a coolant system. Furthermore, an aging coolant system becomes increasingly subject to leakage.

Most engine protection devices sense only the temperature of the engine, and a temperature alarm condition is established based upon an anticipated operating pressure within the coolant system. In such systems a temperature alarm may be energized at a time in which temperature conditions do not justify an alarm, or an alarm may not be energized at a time in which the engine is subjected to damage by excessive heat.

A coolant system which maintains less than an expected operating pressure permits the coolant liquid to boil at a temperature less than that for which the danger signal is designed to operate. Under such conditions, the coolant liquid may boil away and be lost from the coolant system without causing the alarm signal to be energized.

For these reasons, inter alia, devices which have been designed to protect an internal combustion engine against overheating have not been effective.

Thus, it is understood that in order to properly protect an internal combustion engine against overheating, it is necessary to sense both the temperature and the pressure within the coolant system of the internal combustion engine.

It is an object of this invention to provide a switch unit for protection of an internal combustion engine in which the switch unit senses both the temperature and pressure of the liquid in the coolant system and which operates as a function of a combination of the temperature and pressure conditions of the liquid within the coolant system.

Another object of this invention is to provide such a switch unit which is capable of operating and compensating as a function of both the temperature and pressure of a specific liquid in the coolant system.

Another object of this invention is to provide such a switch unit which has relatively long life and which may be produced at relatively low costs.

Other objects and advantages of this invention reside in the construction of parts, the combination thereof, the method of production and the mode of operation of the switch unit as will become more apparent from the following description.

SUMMARY OF THE INVENTION

A pressure compensated temperature switch unit of this invention comprises a housing adapted to be mounted within an opening in a wall of a conduit of a coolant system of an internal combustion engine. The housing has a cavity therein. Within one end portion of the housing is a support member of non-conductive material, such as a plastics material or the like. Attached to the support member is an expansible-contractible member in the form of a bellows, which extends from the support member and into the cavity of the housing.

Within the housing enclosing the cavity and separating the coolant system from the cavity in the housing is a flexible wall in the form of a bellows.

Within the cavity of the housing and encompassing the expansible-contractible member and filling the space in the cavity which is not occupied by the expansible-contractible member is a liquid, which is a good heat transfer medium, which is incompressible, and which has good dielectric characteristics.

Also attached to the support member and extending therefrom is a pair of electric conductor elements, which form a portion of an electric circuit.

Thus, the bellows members and the liquid within the cavity of the housing are subject to pressure and temperature conditions which exist within the coolant fluid which flows in the conduit system. When any combination of temperature and pressure conditions exist within the coolant system and within the cavity of the housing which indicates that a dangerous condition exists, an electric alarm circuit is created through the electric conductor elements. Thus, the temperature of the engine at which an alarm is energized is compensated by the pressure in the coolant system of the engine.

DETAILED DESCRIPTION OF THE INVENTION

Figure 1:
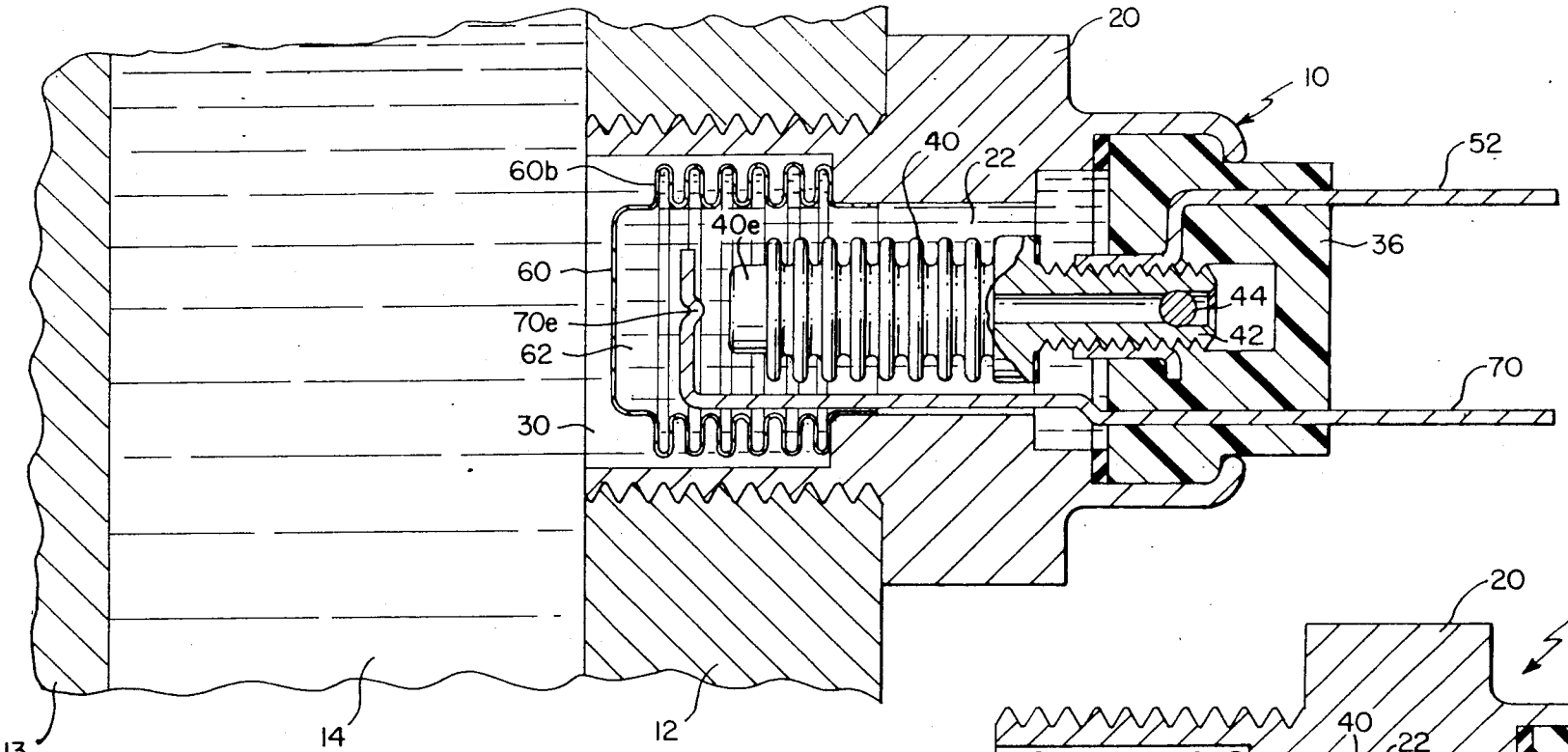
FIG. 1 is a side sectional view of a switch unit of this invention, as the switch unit is installed in association with the engine coolant system of an internal combustion engine. This figure illustrates the switch unit in a de-actuated condition.

FIG. 1 illustrates a switch unit 10 of this invention as it is mounted in a fluid conduit 14 which is formed by a wall 12 and a wall 13. The conduit 14 is a part of a coolant system of an internal combustion engine. Engine coolant liquid flows through the conduit 14, through the engine, not shown, and through a heat exchanger, not shown.

The switch unit 10 comprises a housing 20 which is mounted within the wall 12. The housing 20 has a cavity 22 therein. An opening 30 in the housing 20 leads to the cavity 22 and is in fluid communication with the conduit 14.

Supported by the housing 20 at one end portion thereof opposite the opening 30 is a support member 36 which is made of non-conductive material. Supported by the support member 36 and positioned within the housing 20 is an expansible-contractible member 40, herein shown as being a bellows type of member which has a tubular base portion 42 which is closed by a closure element 44. The tubular base portion 42 is shown as being threadedly attached to the support member 36. However, of course, other means of attachment may also be satisfactory. The expansible-contactible member 40 also has an engagement, end portion **40*e* at the end thereof opposite the base 42. The expansible-contractible member 40** is made of electrically conductive material.

A limited quantity of vaporizable liquid is contained within the expansible-contractible member 40. Preferably, the liquid within the expansible-contractible member 40 has substantially the same composition as the composition of the liquid in the conduit 14 and within the entire coolant system of the engine.

Also, supported by the support member 36 and extending into the housing 20 is an electric conductor member 52, which has a part encompassing the base 42 of the expansible-contractible member 40 and in firm contact therewith.

A cap member 60, attached to the housing 20 and positioned within the opening 30, encloses the cavity 22. The cap member 60 has bellows wall portions **60*b* and is therefore expansible and contractible in length. Within the cavity 22 and encompassing the expansible-contractible member 40 is a liquid 62, which is retained within the cavity 22 by the cap member 60. The liquid 62** is a good dielectric, is incompressible, and has good thermal conductivity.

Extending through the support member 36 is another electric conductor member 70. The conductor member 70 extends into the cavity 22 and extends along the expansible-contractible member 40. The conductor member 70 has an engagement portion **70*e* adjacent the engagement end portion 40*e* of the expansible-contractible member 40**.

OPERATION

During operation of the engine having the conduit 14, coolant fluid flows through the conduit 14. A portion of the coolant fluid flows into the opening 30 and encompasses the cap member 60.

Under normal conditions the engagement portion **40*e* of the expansible-contractible member 40 is spaced from engagement with the engagement portion 70*e* of the electric conductor 70, as shown in FIG. 1**.

The wall 12, the cap 60, and the housing 20 serve as heat transfer agents between the coolant fluid flowing in the conduit 14 and the liquid 62 within the cavity 22 of the housing 20. Therefore, the temperature of the liquid 62 within the cavity 22 of the housing 20 is substantially the same as the temperature of the engine and the coolant fluid flowing through the conduit 14.

Obviously, some of the fluid which flows in the conduit 14 also flows within the opening 30. Therefore, the bellows walls **60*b* of the cap 60 expand and contract in accordance with the pressure of the coolant fluid flowing through the conduit 14 and through the coolant system of the engine. The pressure of the coolant fluid which is applied to the cap 60 is transmitted through the cap 60 to the liquid within the cavity 22 as the bellows walls 60*b* of the cap 60 expand and contract. Therefore, the pressure of the liquid 62 within the cavity 22 of the housing 20 is substantially the same as the pressure of the coolant fluid flowing through the conduit 14**.

Thus, the pressure and temperature of the liquid 62 within the cavity 22 of the housing 20 are applied to the expansible-contractible member 40 within the cavity 22. As stated above, the expansible-contractible member 40 contains a liquid which has substantially the same composition as the coolant liquid flowing through the conduit 14. Therefore, the liquid within the expansible-contractible member 40 responds to temperature in the same manner as the coolant fluid in the coolant system of which the conduit 14 is a part. Therefore, the expansible-contractible member 40 expands and contracts in length in accordance with both the temperature and pressure of the coolant fluid in the conduit 14.

Figure 2:
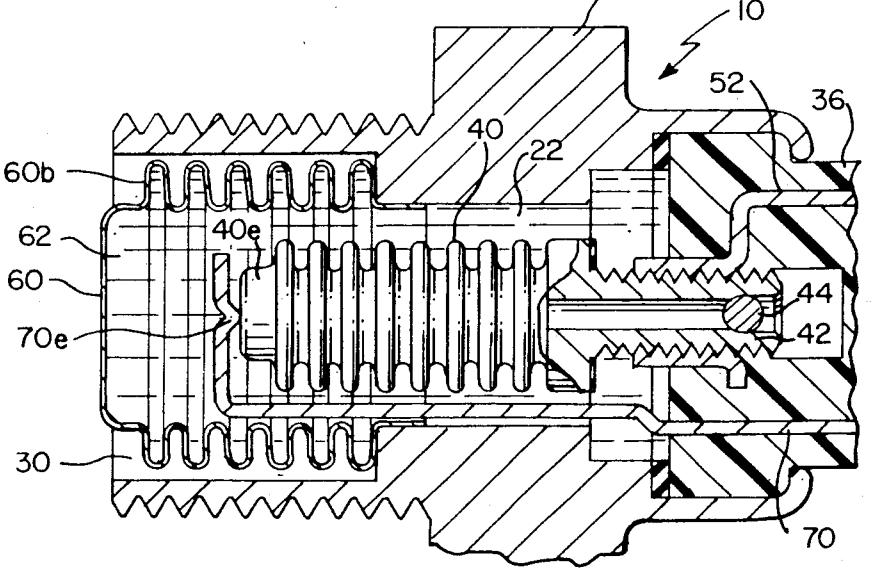
FIG. 2 is a side sectional view, similar to FIG. 1, and illustrates the switch unit in an actuated condition.

The temperature and pressure conditions in the coolant fluid flowing through the conduit 14 may be such that the expansible-contractible member 40 is expanded in length until the engagement portion **40*e* of the expansible-contractible member 40 engages the engagement portion 70*e* of the electric conductor 70, as illustrated in FIG. 2. When this engagement occurs, an electrical circuit is established between the electric conductor 52 and the electric conductor 70. Thus, an alarm, not shown, is energized to warn the operator of the engine that temperature and pressure conditions within the coolant system of the engine are such that dangerous conditions may exist in the engine. The alarm may be audible and/or visible. For example, the temperature of the coolant fluid may become so great that the pressure within the expansible-contractible member 40 overcomes the pressure exterior of the expansible-contractible member 40. When this occurs, the expansible-contractible member 40 expands to the extent that the engagement portion 40*e* of the expansible-contractible member 40 engages the engagement portion 70*e* of the electric conductor 70**.

Thus, it is understood that an alarm is energized in accordance with both the temperature and pressure conditions within the cooling system of an internal combustion engine. It is to be understood that there is effectively an infinite number of pressure-temperature conditions at which the expansible-contractible member 40 expands to the position in which the engagement portion **40*e* of the expansible-contractible member 40 engages the engagement portion 70*e* of the electric conductor 70**.

Also, for example, as a result of leakage, substantially all of the coolant fluid in the cooling system of the engine may be lost. When this occurs, the pressure in the conduit 14 and the pressure in the cavity 22 and the pressure upon the expansible-contractible member 40 is low. Therefore, as the engine operates and creates heat in the coolant system, the liquid within the expansible-contractible member 40 readily expands and the expansible-contractible member 40 readily expands in length and the engagement portion 40*e* engages the engagement portion 70*e* of the electric conductor 70. Thus, an alarm is energized.

Furthermore, when the pressure in the coolant system is significantly high, the temperature of the coolant fluid in the cooling system must become significantly high in order for the expansible-contractible member 40 to expand for engagement between the engagement portion 40*e* of the member 40 and the engagement portion 70*e* of the electric conductor 70.

Thus, it is understood that the switch unit of this invention functions in accordance with a combination of the temperature and pressure of coolant fluid within the cooling system of an internal combustion engine.

Although the preferred embodiment of the engine protective switch unit of this invention has been described, it will be understood that within the purview of this invention various changes may be made in the form, details, proportion and arrangement of parts, the combination thereof and the mode of operation, which generally stated consists in an engine protective switch unit within the scope of the appended claims.

The invention having thus been described, the following is claimed:

1. An engine protective switch unit adapted to be mounted in a coolant system of an internal combustion engine for operation of an engine protective monitoring device, the coolant system having a flow passage through which coolant liquid flows, comprising a housing provided with a cavity therein, the housing having an opening which provides communication between the flow passage of the coolant system and the cavity within the housing, pressure responsive means within the cavity of the housing and having a movable portion which is subject to pressure within the cavity, the movable portion of the pressure responsive means having an electrically conductive part, an electrical engagement member adjacent the movable portion of the pressure responsive means and engageable by the electrically conductive part with movement of the movable portion of the pressure responsive means, vaporizable liquid within the pressure responsive means, the vaporizable liquid being heated by the coolant liquid and vaporizable to apply internal pressure upon the movable portion of the pressure responsive means for movement of the movable portion of the pressure responsive means, the electrically conductive part of the movable portion of the pressure responsive means being movable into engagement with the electrical engagement member by vapor pressure within the pressure responsive means which forces movement of the movable portion of the pressure responsive means.

2. The engine protective switch unit of claim 1 in which the pressure responsive means comprises a bellows type member.

3. The engine protective switch unit of claim 1 in which the vaporizable liquid within the pressure responsive means has substantially the same composition as the coolant liquid which flows in the flow passage of the coolant system.

4. The engine protective switch unit of claim 1 in which the pressure responsive means has a part attached to the housing.

5. The engine protective switch unit of claim 1 in which the pressure responsive means has a part attached to the housing at a position spaced from the opening in the housing.

6. An engine protective switch unit which is adapted to be associated with the coolant system of an internal combustion engine in which coolant fluid flows within the coolant system, comprising:

a housing provided with a cavity therein, the housing having an opening therein to provide communication between the coolant system and the cavity in the housing, a bellows type member attached to the housing and having movable portions within the opening and separating the cavity from the exterior of the housing, a pressure sensitive device within the cavity and having a movable portion, the movable portion including an electrically conductive engagement part, a quantity of vaporizable liquid within the pressure sensitive device and expandible in volume to apply pressure upon the movable portion of the pressure sensitive device to move the movable portion of the pressure sensitive device, an electrical contact member engagable by the electrically conductive engagement part, a liquid encompassing the pressure sensitive device and filling the cavity so that external pressure applied to the movable wall is transmitted through the movable wall to the liquid in the cavity and to the pressure sensitive device, wherein the pressure and temperature of the coolant fluid within the coolant system is transmitted to the pressure sensitive device and to the vaporizable liquid therewithin, the movable portion of the pressure sensitive device thus moving in accordance with the temperature of the coolant fluid as compensated by the pressure in the coolant system and wherein the electrically conductive engagement part moves with movement of the movable portion of the pressure sensitive device, the electrically conductive engagement part moving into contact with the electrical contact member upon sufficient movement of the movable portion of the pressure sensitive device.

7. The engine protective switch of claim 6 in which the pressure responsive device within the cavity of the housing is a bellows member having a portion attached to the housing and a movable portion movable with respect to the housing.

8. An engine protective switch unit adapted to be positioned adjacent a fluid conduit of a coolant system of an internal combustion engine in which there is coolant fluid in the fluid conduit, comprising a housing, the housing having an opening which provides fluid communication between the fluid conduit and the interior of the housing, an operational bellows within the housing, means attaching a portion of the operational bellows to the housing, a quantity of fluid within the operational bellows and expandible to expand the operational bellows, the operational bellows having a movable portion which is movable with expansion and contraction of the bellows, the movable portion including an electrically conductive contact part, an electrically conductive engagement member engagable by the electrically conductive contact part of the movable portion of the operational bellows with expansion of the operational bellows, wherein engagement of the electrically conductive contact part with the electrically conductive engagement member establishes a portion of an electrical circuit, and wherein fluid within the fluid conduit of the coolant system and within the housing applies pressure and heat to the operational bellows, the fluid within the operational bellows expanding in volume in response to heat within the bellows to apply a pressure within the operational bellows to move the movable portion of the operational bellows to move the electrically conductive contact part into engagement with the electrically conductive engagement member.

9. The engine protective switch unit of claim 8 in which the housing includes a support portion of electrical insulator material, and in which the electrically conductive engagement member is carried by the support portion of electrical insulator material.

10. The engine protective switch of claim 8 in which the fluid in the operational bellows is a vaporizable liquid.

11. The engine protective switch of claim 8 in which the coolant system contains a liquid and in which the fluid in the operational bellows has substantially the same composition as the liquid in the coolant system.

12. An engine protective switch unit adapted to be mounted in a coolant system of an internal combustion engine for operation of an engine protective monitoring device, the coolant system having a flow passage through which coolant liquid flows, comprising a housing provided with a cavity therein, the housing having an opening which provides communication between the flow passage of the coolant system and the cavity within the housing, pressure responsive means within the cavity of the housing and having a movable portion which is subject to pressure within the cavity, the movable portion of the pressure responsive means having an electrically conductive part, an electrical engagement member adjacent the movable portion of the pressure responsive means and engageable by the electrically conductive part with movement of the movable portion of the pressure responsive means, vaporizable liquid within the pressure responsive means, the vaporizable liquid being heated by the coolant liquid and vaporizable to apply internal pressure upon the movable portion of the pressure responsive means for movement of the movable portion of the pressure responsive means, the electrically conductive part of the movable portion of the pressure responsive means being movable into engagement with the electrical engagement member by vapor pressure within the pressure responsive means which forces movement of the movable portion of the pressure responsive means, and enclosing bellows which closes the opening and which encloses the cavity of the housing, there being fluid within the cavity of the housing and encompassing the pressure responsive means and filling the space in the cavity which is not occupied by the pressure responsive means.

13. An engine protective switch unit adapted to be positioned adjacent a fluid conduit of a coolant system of an internal combustion engine in which there is coolant fluid in the fluid conduit, comprising a housing, the housing having an opening which provides fluid communication between the fluid conduit and the interior of the housing, an operational bellows within the housing, means attaching a portion of the operational bellows to the housing, a quantity of fluid within the operational bellows and expandible to expand the operational bellows, the operational bellows having a movable portion which is movable with expansion and contraction of the bellows, the movable portion including an electrically conductive contact part, an electrically conductive engagement member engageable by the electrically conductive contact part of the movable portion of the operational bellows with expansion of the operational bellows, wherein engagement of the electrically conductive contact part with the electrically conductive engagement member establishes a portion of an electrical circuit, and wherein fluid within the fluid conduit of the coolant system and within the housing applies pressure and heat to the operational bellows, the fluid within the operational bellows expanding in volume in response to heat within the bellows to apply a pressure within the operational bellows to move the movable portion of the operational bellows to move the electrically conductive contact part into engagement with the electrically conductive engagement member, the housing having a cavity therein, the opening in the housing leading to the cavity, a closure bellows within the opening and separating the cavity from the exterior of the housing, the operational bellows being positioned within the cavity, a liquid within the cavity and encompassing the operational bellows, the closure bellows having movable portions which are engaged by coolant fluid flowing in the fluid conduit, the movable portions of the closure bellows responding to pressure of the coolant fluid in the fluid conduit and transmitting pressure of the coolant fluid to the liquid within the cavity, the liquid within the cavity transmitting pressure and heat to the operational bellows and to the fluid within the operational bellows, wherein the operational bellows expands and contracts in accordance with the temperature and pressure applied thereto.

* * * * *